US005902976A

United States Patent [19]

Beasley

[11] Patent Number: 5,902,976

[45] Date of Patent: May 11, 1999

[54] SYSTEM FOR SEPARATING WASTE MATERIALS BY ENHANCED WATER FLOATATION

[76] Inventor: Donald R. Beasley, 705 Cambridge Rd., Bala Cynwyd, Pa. 19004

[21] Appl. No.: 09/016,449

[22] Filed: Jan. 30, 1998

[51] Int. Cl.[6] ..... B03B 7/00; B03B 5/28; B03D 1/00; B03D 1/24

[52] U.S. Cl. ..... 209/164; 209/170; 209/173; 241/19; 241/20; 241/24.12; 241/24.13; 241/24.18; 241/24.22; 241/DIG. 38

[58] Field of Search ..... 209/162, 164, 209/173, 172, 170; 210/221.2, 703; 241/24.12, 19, 20, 24.13, 24.18, 24.22, DIG. 38

[56] References Cited

U.S. PATENT DOCUMENTS

| | | |
|---|---|---|
| Re. 28,677 | 1/1976 | Blakley et al. . |
| Re. 29,156 | 3/1977 | Marsh . |
| 1,195,264 | 8/1916 | Pennington . |
| 1,298,577 | 3/1919 | Sawyer et al. . |
| 1,548,971 | 8/1925 | Ziska . |
| 3,159,353 | 12/1964 | Atwater . |
| 3,433,356 | 3/1969 | Sommer . |
| 3,477,581 | 11/1969 | Stearns . |
| 3,524,594 | 8/1970 | Anderson et al. . |
| 3,549,092 | 12/1970 | Baxter . |
| 3,568,839 | 3/1971 | Dunlea . |
| 3,595,488 | 7/1971 | Blakley et al. . |
| 3,597,308 | 8/1971 | Brook . |
| 3,738,483 | 6/1973 | MacKenzie . |
| 3,836,085 | 9/1974 | Brown . |
| 3,846,299 | 11/1974 | Krasnoff . |
| 3,897,215 | 7/1975 | Davidson et al. . |
| 3,925,198 | 12/1975 | Eckoff et al. . |
| 3,933,633 | 1/1976 | Saitoh . |
| 3,945,575 | 3/1976 | Marsh . |
| 4,026,678 | 5/1977 | Livingston . |
| 4,049,391 | 9/1977 | Marsh . |
| 4,070,202 | 1/1978 | Nollet . |
| 4,111,798 | 9/1978 | Peterson . |
| 4,210,527 | 7/1980 | Paterson . |
| 4,250,023 | 2/1981 | Samis et al. . |
| 4,264,452 | 4/1981 | Houser . |
| 4,332,677 | 6/1982 | Budzich . |
| 4,479,581 | 10/1984 | Kelyman . |
| 4,561,860 | 12/1985 | Gulley et al. . |
| 4,778,116 | 10/1988 | Mayberry . |
| 4,859,211 | 8/1989 | Moore . |
| 5,101,977 | 4/1992 | Roman . |
| 5,246,116 | 9/1993 | Kirk . |
| 5,250,100 | 10/1993 | Armbristor . |
| 5,341,935 | 8/1994 | Djerf . |
| 5,387,267 | 2/1995 | Warf et al. . |

OTHER PUBLICATIONS

Ohlsson, Oscar O., et al., "Practical Applications of Sizing, Separation, Homogenization and Densification Equipment in the Refuse Derived Fuel )RDF) Industry", *Proceedings of the AIChE 1992 Summer National Meeting,* Aug. 1992.

Arella, David G., Recovering Resources from Solid Waste using Wet Processing, US EPA 530/SW—47d, pp. 1 to 9.

Tchobanoglous, George, et al., *Solid Wastes: Engineering Principles and Management Issues,* McGraw Hill Book Company, 1977, pp. 225, 226, 305, and 306.

"The Next Generation of Waste–to–Energy", *Solid Waste Technologies,* Sep./Oct. 1997, p. 40.

*Primary Examiner*—Thomas M. Lithgow

[57] ABSTRACT

Improved control for the separation of waste materials, or materials having waste components, is provided by the injection of air, or other gas bubbles, into a water-filled tank while simultaneously depositing the waste containing material to be separated onto the top of the water. This method is especially useful where both portions of some or all of the materials to be separated from each other have specific gravities greater than that of pure water. The rapidly rising air bubbles provide turbulence and buoyancy to materials that are slightly heavier than water, such as water-soaked organic products, but do not prevent heavier materials, such as sand and metals from sinking. An apparatus is described which allows for the removal of both the floating and sinking fractions from the floatation tank. The cleaner separation provided by this method increase the value of both fractions for a variety of beneficial uses including manufactured products, a renewable-resource fuel which will reduce the generation of greenhouse gases, chemical product feedstock and compost.

13 Claims, 2 Drawing Sheets

SYSTEM FOR SEPARATING WASTE MATERIALS BY ENHANCED WATER FLOATATION

BACKGROUND

1. Field of Invention

This invention relates to the separation of waste ingredients from a mixture of materials, including, but not limited to, mixtures of waste materials, specifically by aerating the mixture in a water-filled floatation container.

2. Description of Prior Art

Prior to about 1960, the disposal of waste material was of little concern to the public at large. Household garbage was dumped at any out-of-the-way spot on land that was not needed for some other purpose. Leaves and other yard wastes were simply burned at the generation site or in the street, instead of being composted. Apartment building operators in large cities simply burned their garbage in an incinerator located in the building. Both the soot and the odors were very noticeable. However, over the past thirty-five years, the generation of waste materials has been viewed as both a costly disposal nuisance and as an opportunity to recover some value from reuse of the waste materials. The incentive to find uses for the components of waste has been further enhanced by recognition that when all or a portion of a waste material can be used again, added value is also gained by avoiding the alternative cost of disposal. The most effective uses of the waste ingredients contained in mixed waste materials, such as Municipal Solid Waste (MSW), require that at least a partial separation of these waste materials be effected. For example, even if the primary reuse of the ingredients is as fuel for the purpose of generating energy, a better result is achieved if a large portion of the non-combustables and water are removed prior to the remainder being used as fuel. Where the ingredients of a waste mixture are to be reused for the same or another similar beneficial use, the value of the separated components are increased in accordance with the completeness of the separation. For example, metals designated for recycling should be free from other contaminants and, likewise, fibers which are to be reconstituted to new higher-value paper-like products need to be cleaner than when the same fibrous materials are used as raw fuel products. Also, the more completely that individual ingredients can be separated from mixed waste materials, the lower the disposal cost of residuals. For example, even though non-metallic inorganic waste material, such as sand and grit, may have a low intrinsic value, if that material can be made free of prutricables and organic material in general, it can be used for low-cost construction fill, rather than having to incur the alternative higher cost of sanitary landfill disposal. It is understood that landfills are not permanent disposal options. Many old landfills are leaking toxic materials to the groundwater, which has required that they be excavated and processed a second time for disposal. Thus it can be seen that there is an economic incentive to develop and employ improved methods of separating waste materials. This incentive has been increasing at a rapid rate in recent years, because disposal costs to sanitary landfills and mass-burn incinerators have increased disproportionately to the general economy, due primarily to more stringent environmental regulations.

A comprehensive review of past art, from publications and from patents that have been granted, shows that a wide range of methods have been employed for the separation and removal of waste materials from mixed wastes, including but not limited to Municipal Solid Waste (MSW). These methods can be categorized as follows: 1) manual separation, 2) screening, either before or after comminution, 3) contact with an upwardly moving air stream, 4) electromagnetic and optical, and 5) floatation in a liquid medium, including water. These methods have been employed both singularly and as systems which combine two or more methods.

In addition to the manual separations performed by MSW generators (i.e. the general population) through the mandatory curbside recycling programs, many commercial systems also rely on manual separation as the primary method of MSW processing for the recovery of specific ingredients. For example, U.S. Pat. No. 4,859,211 to Moore discloses a process in which MSW is manually sorted to separate materials of different value and degrees of contamination, including a portion which is processed to produce a fuel pellet. Likewise, U.S. Pat. No. 5,250,100 to Armbristor discloses a manual sorting technique wherein a large portion of the separated waste is directed to a composting operation. Manual sorting can provide very clean separations if performed at the source by the individual generators; however, this method causes high collection costs and places unnecessary burdens on the population. Manual separations of wastes after they have been co-rmingled (allowed to mix) are very labor intensive, generally expensive, viewed by some as a demeaning activity, and are not very effective in dealing with the removal of cross contamination (i.e. providing clean products).

The application of physical screening to effect MSW ingredient separation is based on experience that the non-combustable ingredients in MSW tend to be of smaller physical size than combustables. For example a piece of glass or dirt is usually smaller than a sheet of newspaper or cardboard. Therefore, if after the application of some mechanical action to expose the components of bagged material, the entire MSW is screened, the fraction which is composed of larger sized pieces will have a lower non-combustible content than the other fraction. The fraction containing the larger components can then be further processed to produce a refuse derived fuel (RDF) or some other beneficial use. For example, U.S. Pat. No. 5,101,977 to Roman discloses a multiple screening approach to MSW separation. Likewise, U.S. Pat. No. 4,479,581 to Kelyman, U.S. Pat. No. 4,561,860 to Gulley et. al., and U.S. Pat. No. 4,778,116 to Mayberry all disclose mechanical screening as a key component of their MSW processing systems. While it is true that selective screening will generally result in two fractions with different ratios of combustible to non-combustible fractions than the starting composition, unless further processing is employed, both portions separated by the screening method are generally only useful for low value applications, such as low-quality (dirty) fuel and compost.

Many of the largest commercial MSW separation operations have utilized some sort of air floatation apparatus for the separation of useable ingredients. For example U.S. Pat. No. 3,524,594 to Anderson et al, U.S. Pat. No. 3,738,483 to MacKenzie, U.S. Pat. No. 3,836,085 to Brown, U.S. Pat. No. 3,925,198 to Eckoffet al, U.S. Pat. No. 4,070,203 to Nollet, U.S. Pat. No. 4,210,527 to Patterson et al, and U.S. Pat. No. 4,264,352 to Houser all disclose apparatuses that use an upward flow of air to separate the ingredients of mixed waste into two or more portions. This method is very effective for some separations, such as separating a chunk of glass or a heavy metal object from lighter materials, such as paper and plastic items. The two principal disadvantages of air-float separation (where the objective is specifically to separate organic from inorganic materials) are that this method 1)

does not effectively prevent buoyant inorganics, such as aluminum foil, and imbedded dirt from being carried along with the desired organic-rich portion, and 2) the heavier particle inorganic residue portion has a high organic content which makes it unsuitable for such applications as construction fill.

Electro-magnetic devices are commonly used to separate metals from mixed waste. Iron and most grades of steel can be extracted from a mixture of materials with a conventional magnet. Following the removal of magnetic materials, other electrically conductive material, such as aluminum, copper and non-magnetic stainless steel, can be removed using an eddy-current separator. These devices are very effective in removing metal from mixtures of other materials; however, they have no effect on the separation of non-conductive materials, such as the removal of sand and glass from paper, plastic and other organic wastes. These electromagnetic devices are usually used in combination with other separation methods. For example, U.S. Pat. No. 5,341,935 to Djerf et al and U.S. Pat. No. 5,387,267 to Warf disclose magnet separation followed by eddy current separation to remove metals from mixtures of waste materials. Optical scanners have been used, with apparent limited success, to separate glass from other mineral materials.

A summary of the commercial application of the above referenced approaches to waste separation methods has been provided by the U.S. Department of Energy in a Argonne National Laboratory publication, *Practical Applications of Sizing, Separation, Homogenization and Densification Equipment in the Refuse-Derived Fuel (RDF) Industry*, Oscar O. Ohlsson, et. al., presented at the AIChE 1992 Summer National Meeting, August, 1992.

Floatation in liquids, including water, is one of the oldest recorded methods of separating materials having different specific gravities. For example, U.S. Pat. No. 1,298,577 to Sawyer et al in 1919 discloses the separation of gold from sand using a device that allows heavier gold to settle out of a moving water stream, in which the sand remains suspended. Likewise, U.S. Pat. No. 1,548,971 to Ziska in 1925 discloses the separation of rocks from wood chips by using an apparatus which subjects the mixture of wood chips and foreign particles, such as rocks and nails, to an upward flow of water. The inventor, Ziska, specifically notes in his patent that an upward flow of water is necessary to prevent water-soaked wood chips from sinking along with the foreign particles that are being removed from the bottom of the floatation apparatus. Since the granting of U.S. Pat. No. 3,159,353 to Atwater in 1964, there have been numerous patents issued which describe modified approaches to the separation of mixed waste materials using liquid floatation methods. Examples of U.S. Patents, which employ water floatation to separate the ingredients in Municipal Solid Waste, include U.S. Pat. No. 3,568,839 to Dunlea, U.S. Pat. No. 3,597,308 to Brooks, U.S. Pat. No. 3,897,215 to Davidson et al, U.S. Pat. No. 4,250,023 to Samis et al, and U.S. Pat. No. 5,387,267 to Warf. In each of these cases the stated objective is to obtain a complete separation of organic material, including paper, textiles, wood, plastic and food waste from inorganic materials, such as metals, glass, sand and dirt in order to produce a low ash content fuel or compost material. However, unlike Ziska in his method for cleaning wood chips, none of these disclosures, with the exception of Brooks, recognize that most fibrous organic materials will also sink in water (when they become water-soaked) along with many types of plastic, unless some method of increased buoyancy is provided. Brooks recognizes three specific gravity categories associated with float separation in water; however, he uses a screw device rather than an upward flow of water to increase the buoyancy of organic materials having a higher specific gravity than that of water. Warf, on the other hand, asserts that all organic materials in mixed waste float while the inorganic materials sink, which is not usually the case. The incomplete separation, which results from traditional water-floatation methods, will both reduce the total recovery of useful organic materials and cause the sunken inorganic residue to be contaminated by organic material, such that it may require expensive landfill disposal rather than beneficial construction fill use.

Another approach to the use of water to separate fibrous organic materials, such as paper, from undesirable inorganic material is to first comminute or disintegrate the fibrous material by the high-speed wet shearing action of a hydro-pulper. The disintegrated material, along with only small particles of grit, are extracted in slurry form through the small holes of a perforated plate in the bottom of the hydro-pulper. Most of the remaining grit in the paper slurry can then be removed by conventional liquid cyclones. These liquid cyclones separate high specific gravity particles from the remaining mixture of water and lower specific gravity materials. If the hydro-pulper feed contains materials that do not disintegrate by the wet shearing action, such as the metals, plastic and glass (such as found in MSW), these materials will not pass through the perforated plate of the hydro-pulper and are periodically removed from the main chamber of the hydro-pulper. This method of separating waste materials was first disclosed in U.S. Pat. No. 3,549,092 by Baxter and assigned to the Black Clawson Company. Subsequently several other patents disclosing modifications and improvements of this method have been granted and assigned to the Black Clawson Company. These include: U.S. Pat. Nos. 3,595,488 and RE28,677 to Blakey et al. and 3,945,575, RE29,156, and 4,049,391 to Marsh. U.S. Pat. No. 4,026,678 to Livingston also includes hydro-pulping as a part of a process to produce fuel pellets. Commercial operation of this method by the Black Clawson Company is described in a 1974 EPA publication *Recovering Resources from Solid Waste Using Wet Processing*, EPA 530/SW-47d and on pages 225, 226 and 305 of the book *Solid Waste: Engineering Principles and Management Issues*, authored by George Tchobanoglous, et al, and published by McGraw Hill in 1977. The use of a hydro-pulper as a first step in a waste separation process is also described in a magazine article, "The Next Generation of Waste-to-Energy", *Solid Waste Technologies*, pg. 40, September/October 1997. It can be noted from these literature references that in the commercial application of this wet comminution method, no separation of waste materials was employed prior to the waste material being fed to the hydro-pulper. The fiber separated from Municipal Solid Waste (MSW) by this process in the Black Clawson commercial demonstration operation was used primarily as the paper mat foundation for asphalt roofing shingles. By using multiple liquid cyclones after the hydro-pulping, a very clean, low-ash fiber was produced. However, because there was no separation of abrasive materials, such as glass and metals, prior to the hydro-pulping operation, reduced capacity and high maintenance costs of the hydro-pulper were incurred. A hydro-pulper operates like a giant under-the-sink garbage disposal, which can be progressively damaged by including hard materials, such as glass and metal, with the food waste.

Objects and Advantages

Accordingly, several objects and advantages of my invention are:

a) to provide an improved separation of materials having different specific gravities using a simple water-floatation tank by providing controlled buoyancy from the injection of air or other suitable gas, to create turbulence and an upward flow of water along with the lower and medium specific gravity (less than 2.0) constituents;

b) to provide a method by which materials which would normally sink in water, such as certain plastics and water-saturated paper and textiles, can be caused to float while still heavier materials, such as metal and glass will sink;

c) to provide a water-floatation method by which large volumes of water do not need to be managed, as is the case when upwardly moving water instead of air or other suitable gas is used to provide additional buoyancy;

d) to provide a low-cost method of reprocessing old sanitary waste landfills to recover useful ingredients;

e) to provide a waste materials separation method by which when recycled water is used in the separation of biodegradable organic materials, the aeration to provide buoyancy also serves to purify the water in the same manner commonly employed in conventional wastewater treatment plants;

f) to provide a method of separating materials, which will reduce the operating and maintenance cost of equipment used to produce and process fibrous slurries by the wet comminution process, g) to provide a method of separating waste materials, which will reduce the risk of fire and explosion.

Still further objects and advantages will become apparent from a consideration of the ensuing description and accompanying drawings.

PREFERRED EMBODIMENT

Description

Figure 1:
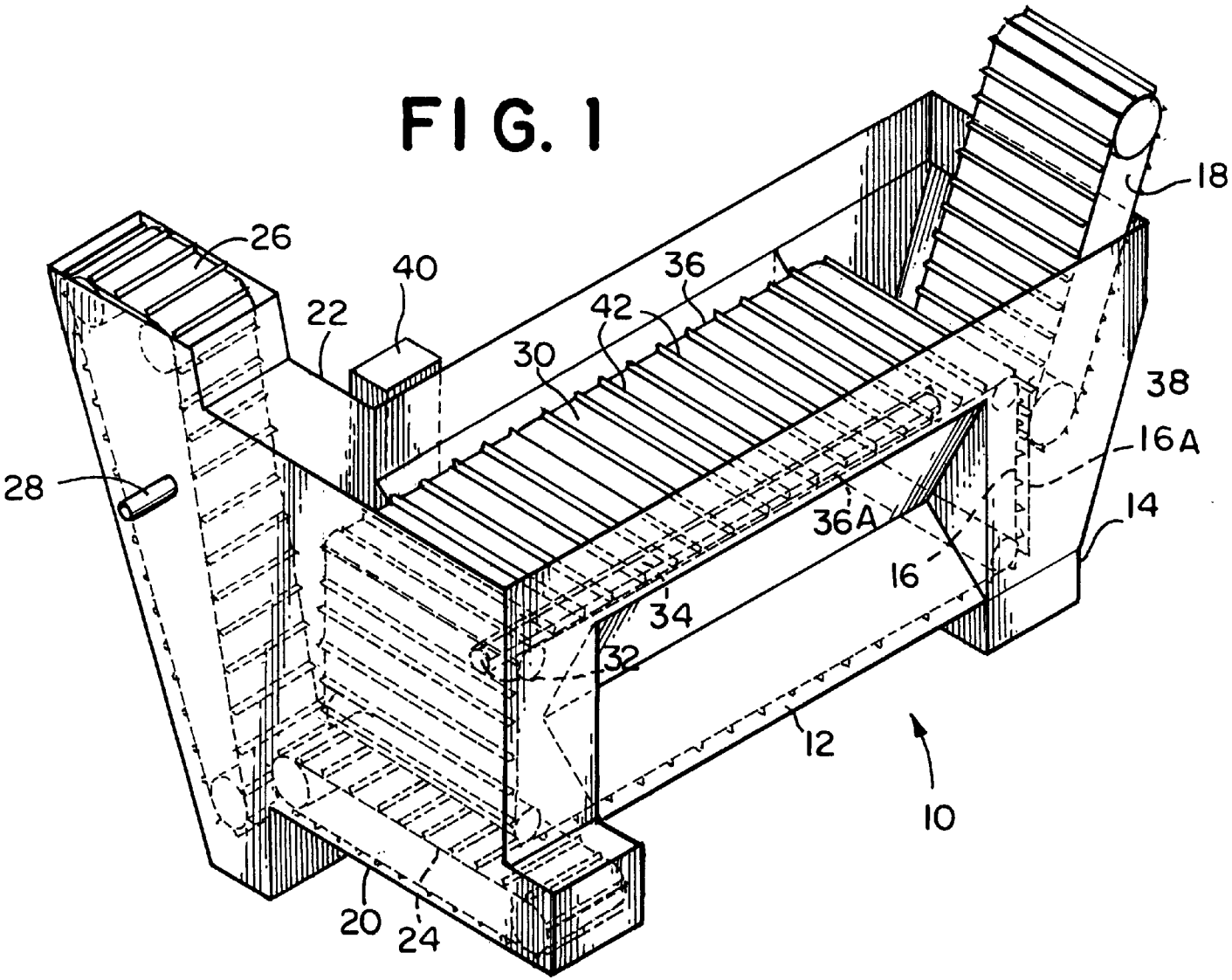
FIG. 1 is a perspective view of an apparatus that can be used to implement the method which is my invention.
Figure 3:
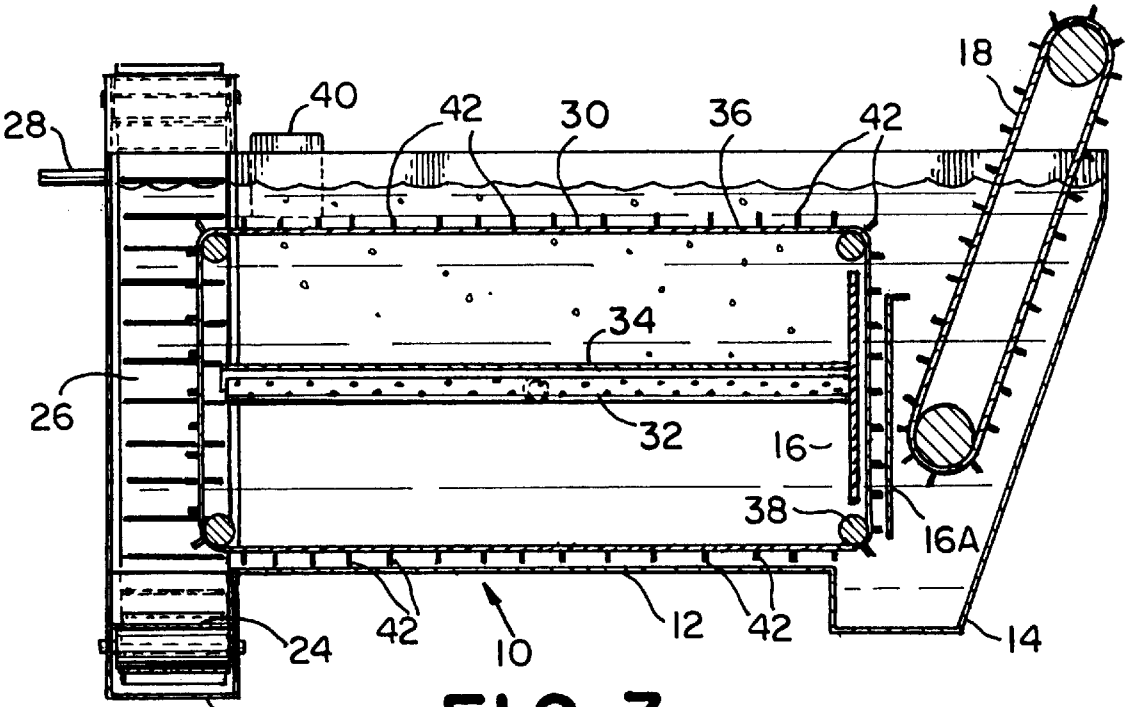
FIG. 3 is a cross section view of the portion of the apparatus indicated by section lines 3—3.
Figure 2:
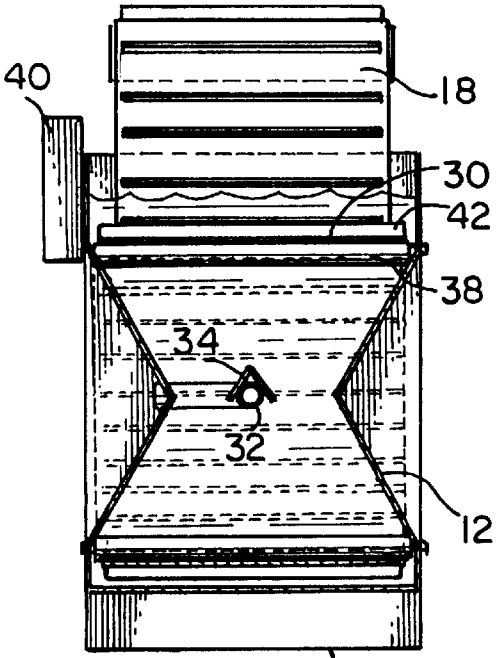
FIG. 2 is a cross section view of the portion of the apparatus indicated by section lines 2—2.

FIGS. 1–3 illustrate an apparatus which can be used to implement my invention, which is an improved method for separating materials having different specific gravities. As will be evident from a description of this apparatus and the manner in which it is used, this method is especially useful when the desired separation includes two groups of materials where both groups of materials have components with specific gravities greater than that of water, which is approximately 1.0 depending on the temperature and purity of the water. This apparatus and those of similar design provide a controlled flow of air, or other suitable gas, into the mid or lower portion of a water-floatation container device. In the subsequent description of this invention, the word "air" means natural air or "any other suitable gas", except that there are certain specific benefits to using air as the gas of choice. These benefits will be described later as part of the description of the invention. The upward movement of air in a body of water creates buoyancy by the introduction of a force component to materials deposited onto the top surface of the water. This buoyancy will cause some materials that would normally sink in still water to remain suspended in the water above the point where the air is injected. However, by controlling the quantity of injected air, heavier and less buoyant materials can be allowed to sink below the air injection level of the water-filled container.

While this method may be applied to the separation of many materials having different specific gravities, it is especially useful in separating the components of Municipal Solid Waste (MSW) into two fractions, where one of the fractions should be very high in organic content and the second fraction should be very low in organic content. Since almost all of the inorganic constituents of MSW have specific gravities in the range of from 2 to 10 times more than that of pure water, water is an effective media for the removal of unattached inorganic material from any organic material that has a specific gravity of less than 1.0 and also those organic materials that can otherwise be made to float in water, such as those organic materials having specific gravities of more than 1.0 but less than 2.0. However, many organic materials, including some plastics, vegetable matter and both paper and textiles that are water-logged will sink in plain water, unless a buoyant force is applied to these materials. In a water-floatation separation system, sinking organic material will result in both a loss of recovery of the organic portion and in organic contamination of the sinking inorganic fraction. To prevent the heavier-than-water organic material from sinking, additional buoyancy can be achieved by 1) increasing the density of the water phase, such as by the addition of salts to the water, 2) by creating an upward movement in the water flow or 3) as is the object of this invention, by gas injection below the floating material, a suitable gas being air. This air, or alternative gas, can be injected directly through sparger jets into the floatation container. It can also be injected indirectly by first dissolving the air or other gas under pressure in a portion of water, which may be subsequently injected into the floatation container, such that the gas will be caused to be released by the reduction in pressure, which will be encountered in the floatation container.

Referring now to the drawings and in particular to FIGS. 1 and 3, it can be seen that an apparatus which may be used to implement this invention includes a main container 10, which is comprised of three sections. The primary function of each of these three sections is described in this paragraph. The center section is the primary water-floatation section 12, which receives the mixed material and in which separation by gravity occurs. A detailed discussion of its operation is presented in the next paragraph. The second section, which is the floating materials receiver 14, is a chamber which receives the floating material from section 12. The lower portion of section 12 is separated from section 14 by a partial barrier walls 16 and 16A. The purpose of these barrier walls is to prevent: 1) heavier material, which has settled in section 12, from being transported into section 14, and 2) lighter material, which has been deposited in section 14, from being transported into the lower portion of section 12. Section 14 also includes a means for removal of the floating material, such as the continuous belt conveyor 18. Any other suitable means of removing material from section 14 may be used, including but not limited to: other conveyor designs, augers, bucket elevators, drag chains, slurry pumps, and crane operated clam-shell buckets. The third section, which is the heavy materials section 20, is a chamber which receives material that has settled in the receiving and floatation section 12. Except for a narrow opening at the bottom, section 20 is separated from section 12 by a high barrier wall 22. Section 20 also includes a means of removing heavy materials that sink to the bottom of section 12, such means include devices such as a horizontal conveyor 24 and an inclined conveyor 26. Any other suitable means of removing material from section 20 may be used. A maximum water level in the three sections 12, 14 and 20 can be maintained by an overflow outlet 28. Since the three sections are connected hydraulicly, there are many acceptable locations for outlet 28; however, it is preferred that this outlet be at a point where significant amounts of solid material will not be removed with the water. In the implementation of this invention, it is intended that a surplus of water will be supplied to the apparatus with the feed material that is being separated by the method of this invention. If the feed material contains less water than what is being removed with the separated material from sections 14 and 20, additional water may be supplied to maintain a level equal to the elevation of the overflow pipe 28.

This invention is best illustrated by FIG. 2, which is a cross section view of the primary receiving and floatation chamber, section 12. The three principal features of this apparatus are: 1) the container configuration with sloping walls, which is shown as section 12; 2) a continuous paddle-chain conveyor 30, which moves floating material to section 14 and sunken material to section 20; and 3) an air dispensing and distribution assembly consisting of a sparger pipe 32 with perforations to release air and a shroud 34 with serrated edges to disperse the air into smaller bubbles. The paddle-chain conveyor consists of two chains 36 and 36A which are supported on sprockets 38*a–h*, where at least one sprocket connected to each chain is driven by a shaft and motor assembly 40. Spanning and attached to the two chains 36 and 36A are rectangular paddles 42*a–n*. For the apparatus used to illustrate this invention, the walls of the floatation section 12 are tapered inward from the top down, such that the narrowest point is in the area where the air is released across shroud 34. The purpose of this arrangement is to economize on the quantity of air required by providing the maximum velocity and resultant buoyancy at the most critical separation point between sinking materials, especially the sinking organic materials, while at the same time providing a larger area for the movement of free floating material at the top of this section. Section 12 is flared out below the air release point 34 simply to accommodate movement of the paddle-chain conveyor in its continuous circular path. At the bottom of section 12, the paddle-chain conveyor 30 moves in contact with the floor of the section, such that sunken material is transported to section 20 for subsequent removal. In addition to FIG. 2, the components of section 12 can also be seen in FIGS. 1 and 3. The specific dimensions of section 12 are not critical to the implementation of this invention, but should be optimized for maximum performance based on the specific materials to be separated.

It is intended that for the most satisfactory performance of the apparatus described, being container 10 and its supporting parts, feed material should be introduced to the top of section 12 near the point where it attaches to section 20, so that the heavy materials will have time to settle below the air injection point at shroud 34 before reaching section 14. If the material to be separated is very non-uniform in size or contains inorganic components which are buoyant because of trapped air, such as containers and bagged material, a first step of implementing the invention should be a size reduction operation such as but not limited to crushing, shearing, water-jetting, flailing or wet milling. It is preferable to perform any of these first size-reduction operations as a water dispersion to increase the scrubbing action and to reduce explosion hazards.

Air or other suitable gases may be supplied to the sparger pipe 32 directly as a compressed gas or indirectly as a solution of gas in pressurized water. The rate of air release can be controlled, and changed from time to time, by a standard regulator valve in order to achieve the desired level of material separation. As an alternative to the serrated edges, shroud 34 may be formed in whole or in part from screen configuration material, to achieve the desired result of bubble dispersion. Alternatively, a porous pipe, such as those made from sintered metal, or one with many very small holes, may be used for the sparger pipe 32 to increase bubble dispersion, in which case it could be satisfactory to remove shroud 34.

As has previously been disclosed by others, a similar buoyancy effect as that which is produced by this invention can be created by an upward flow of water. However, the advantages of using air instead of water are several, including: 1) less energy to provide the required buoyancy, 2) less water overflow to be managed, and 3) in the case of waste processing where dissolved organic compounds can accumulate in the recycled water, the aeration will also serve a dual purpose by purifying the water.

Reference Numerals

10 main container
12 water-floatation section
14 floating materials receiver
16 partial barrier wall
16A partial barrier wall
18 continuous belt conveyor
20 heavy materials section
22 high barrier wall
24 horizontal conveyor
26 inclined conveyor
28 overflow outlet
30 continuous paddle-chain conveyor
32 sparger pipe
34 shroud
36 chain
36A chain
38 sprockets
40 shaft and motor assembly
42 rectangular paddles

Conclusions, Ramifications, and Scope

Accordingly, it can be seen that this invention provides a superior method of separating mixtures of materials having different average specific gravities into two fractions, namely a light fraction and a heavy fraction. The method described is especially useful in cases where, 1) water, including water scrubbing, is used prior to the separation activity to detach dissimilar materials, such as dirt and food particles from paper, textiles and food containers and, 2) the light fraction contains materials having specific gravities slightly higher than that of water, but not as high as the inorganic materials such as metal, glass and rocks.

Although the description above contains many specificities, these should not be construed as limiting the scope of the invention, but as merely providing illustrations of some of the presently preferred embodiments of this invention. Various other embodiments and ramifications are possible within it's scope. For example, where the objective of processing waste material is to extract fibrous organic material for beneficial use by using a hydro-pulper or other high-speed comminution device, production rates will be increased and maintenance costs reduced by first using the method of this invention to remove inorganic material prior to the hydro-pulping operation. Clean organic materials produced by the separation method of this invention may be used for a wide variety of high-value uses including: paper and cardboard products, a base material for hydro-seeding, biodegradable pots for plants which are to be transplanted, kitty litter, compost and potting soil, fuel, chemical feedstock and numerous other applications. Where an objective of processing waste material is also to recover inorganic material, such as metals, glass and clean construction fill material, the economic value of these produces is increased by using the method of this invention to produce these products without organic contamination. Furthermore, where waste materials to be processed may contain hazardous materials such as gasoline, paint solvents, dynamite, ammunition and like materials, this method of processing reduces fire and explosion hazards. The injection of air into the water system as a part of the materials separation process, purifies the system without having to create a separate operation for this purpose.

Thus the scope of the invention should be determined by the appended claims and their legal equivalents, rather than by the examples given.

SUMMARY

The objective of this invention is to provide better separations of mixed materials having different specific gravities, especially waste products, in order to increase the value of the separated materials in a variety of markets and to reduce the cost of subsequent processing operations, such as hydro-pulping. This invention satisfies the objective by combining water floatation with air injection. The method claimed in this invention is intended to be combined with other known processing technologies. Specifically it is an improvement on conventional water-float separation methods, which are well established but have deficiencies in the manner in which they are currently practiced, especially in their dealing with mixed organic and inorganic materials, such as but not limited to Municipal Solid Waste.

What is claimed is:

1. A method for separating materials having different specific gravities from a mass of mixed waste by depositing said mixed waste onto water in a suitable container; injecting a bubbleproducing producing gas under said mixed waste in said container, the gas injection being controlled to induce turbulence in the water, wherein the volume of the injected gas is controlled so as to raise materials having specific gravities of equal to or less than 2.0 to the top of the container for recovery, while allowing materials having specific gravities which are greater than 2.0 to settle to the bottom of the container for recovery, recovering said raised materials and converting said recovered raised materials to at least one useful product selected from the group consisting of fuel, chemical feedstock, paper-based products, kittylitter, plant potting soil, biodegradable pots for plants, hydro-seeding base, and compost.

2. The method in claim 1, wherein depositing of said mixed waste and injecting said gas occur simultaneously.

3. The method in claim 1, wherein said separated materials which settle to the bottom of said container are recovered and converted to at least one useful product selected from the group of ferrous metal products, non-ferrous metal products, glass products, construction fill, and sanitary landfill cover.

4. The method in claim 1, wherein said injected gas is air.

5. The method of claim 1, wherein said mixed waste contains both organic and inorganic components.

6. The method in claim 1, wherein said mixed waste is municipal solid waste.

7. The method in claim 1, wherein said mixed waste is commercial solid waste.

8. The method in claim 1, wherein said mixed waste is obtained from an existing sanitary landfill.

9. The method in claim 1, wherein said container includes means for separately removing raised material from the top of said container and means for removing settled material from the bottom of said container.

10. The method in claim 1, wherein the container is configured to cause the concentration of said gas bubbles to be greater near the point of said injection than at higher locations in said container.

11. The method in claim 1, wherein said mixed waste is first processed to change the shape of at least a portion of the components contained in said waste materials.

12. The method in claim 11, wherein the conversion of recovered materials to at least one useful product involves processing said recovered materials in a high-speed shearing device.

13. The method in claim 12, wherein said high-speed shearing device is a hydro-pulper.

* * * * *